US005297651A

United States Patent [19]

Vandelinde

[11] Patent Number: 5,297,651

[45] Date of Patent: Mar. 29, 1994

[54] SAFETY LOAD TRANSFER DEVICE AND SYSTEM

[75] Inventor: Henry Vandelinde, Scarborough, Canada

[73] Assignee: Swingstage Limited, Scarborough, Canada

[21] Appl. No.: 53,289

[22] Filed: Apr. 28, 1993

[51] Int. Cl.[5] ..... A62B 37/00

[52] U.S. Cl. ..... 182/3; 182/36

[58] Field of Search ..... 182/3, 45, 36, 12; 248/237, 68.1; 104/115; 188/65.1

[56] References Cited

U.S. PATENT DOCUMENTS 2,462,969 3/1949 Holliday ..... 188/65.1
4,790,410 12/1988 Sharp et al. ..... 182/3
5,224,427 7/1993 Riches et al. ..... 182/3

*Primary Examiner*—Alvin C. Chin-Shue

*Attorney, Agent, or Firm*—Arne I. Fors

[57] ABSTRACT

A load transfer device and system having double safety cables permitting users to move freely and safely along elevated surfaces comprising a plurality of elongated T-shaped support brackets each having a body portion for anchoring to a support surface and a head portion for receiving a pair of equispaced cables. A load transfer device for slidable travel on the pair of cables and past the support brackets comprises a rectangular plate for receiving a lanyard, said plate having a pair of elongated hook-shaped jaws hingedly secured to each edge of the rectangular plate for receiving a safety cable therein, each said elongated hook-shaped jaw hinged to a side edge of the rectangular plate whereby the said jaw is substantially planar with the plate during no-load conditions and whereby the load transfer device can freely pass a support bracket during no-load conditions.

3 Claims, 4 Drawing Sheets

FIG. 3.
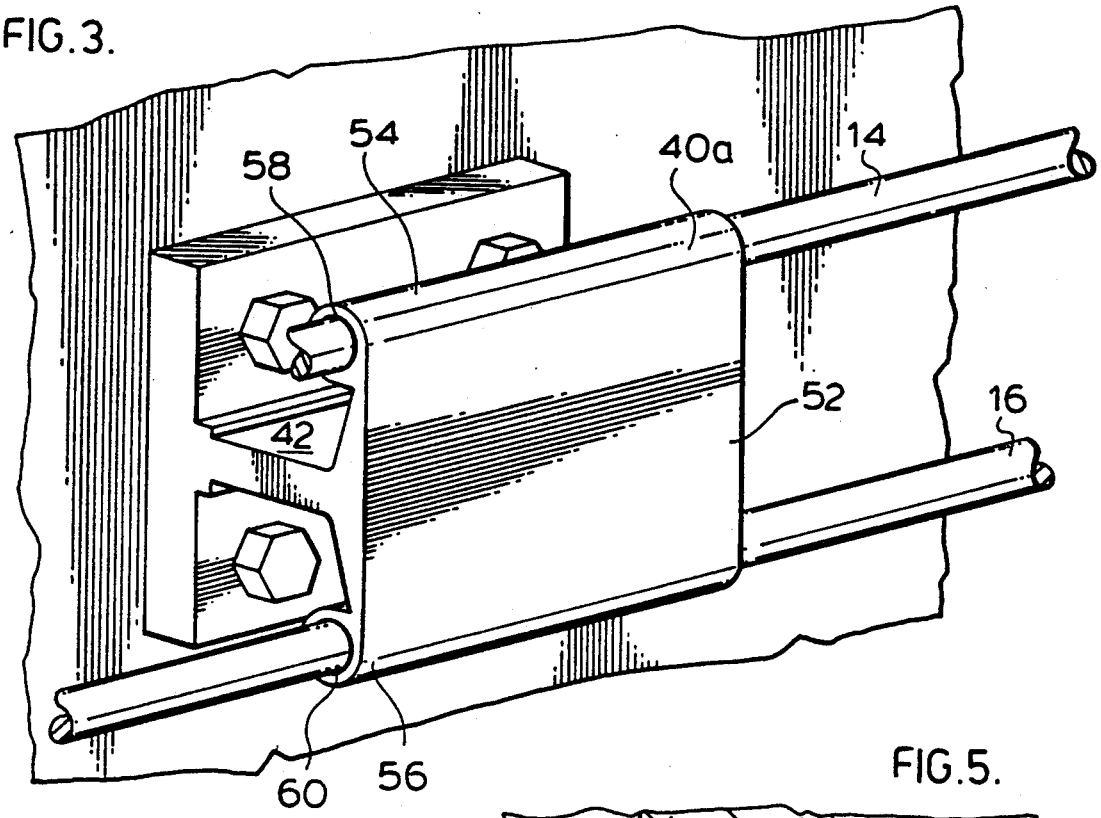
FIG. 5.
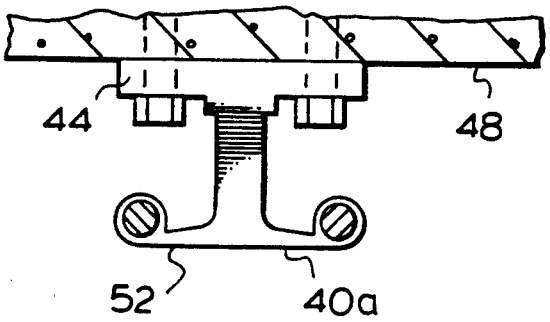
FIG. 4.
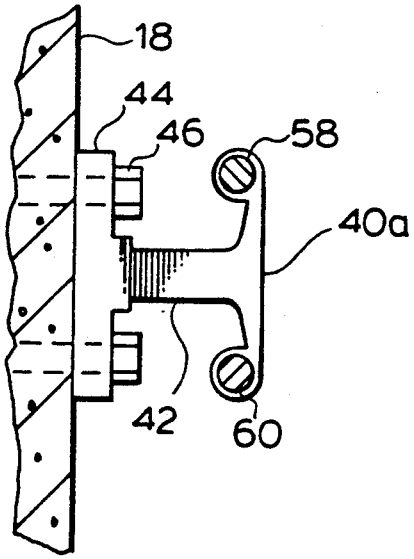
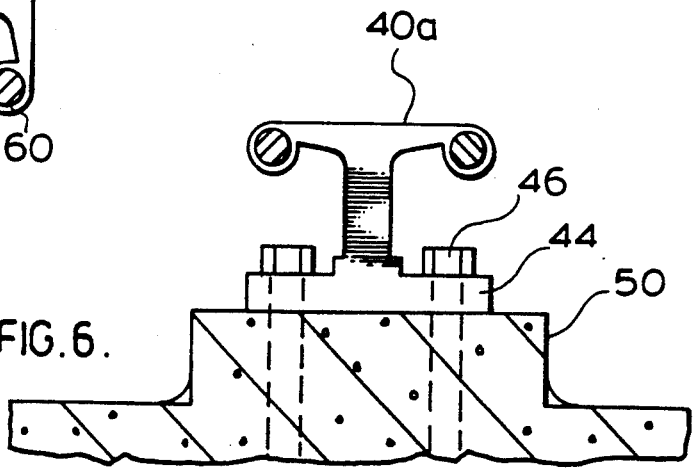
FIG. 6.

SAFETY LOAD TRANSFER DEVICE AND SYSTEM

FIELD OF THE INVENTION

This invention relates to a load transfer device and system and, more particularly, relates to a load transfer device and system which permits a user or other load attached thereto to move or be moved along a path and past load bearing supports.

BACKGROUND OF THE INVENTION

Safety line systems for use with horizontal life lines to protect workers from risk of injury or death from a fall when working close to a vertical face such as when washing windows of a high rise building are well known. U.K. Patent Specification No. 1,582,201 discloses a load-transfer device for use by workers in the building and mining industries which enables a load to be moved along a path and past load bearing supports. A rotatable wheel having recesses in its periphery is adapted to slide along a single safety wire and to pass the loops of a hanger secured to a support surface.

The Barrow Hepburn Sala SAYFGLIDA TM life line system is another fall-arrest safety sytem which allows a worker to move safely along a horizontal plane tethered to a safety line. A link attached to a harness lanyard and travelling along a support line has a longitudinal slot formed along a side for passing the arm of a support bracket.

SUMMARY OF THE INVENTION

It is a principal object of the present invention to provide a load transfer device and system which allows users to move freely and safely along elevated surfaces.

Another object of the invention is the provision of a load transfer device and system having double safety cables for an additional margin of safety while ensuring the load transfer device remains aligned with support brackets.

A further object of the invention is the provision of a load transfer device having a pair of anchor jaws adapted to engage the safety cables when under load.

These and other objects of the invention and the manner in which they can be attained will become apparent from the following description of the invention which, in its broad aspect, is a load transfer system comprising a plurality of elongated T-shaped support brackets each having a body portion for anchoring to a support surface and a transverse, thin head portion having longitudinal, parallel side edges, said side edges each having a longitudinal opening formed therein for receiving a pair of equispaced cables, and a load transfer device for slidable travel on the pair of cables and past the support brackets.

Each load transfer device for travelling along a pair of cables and past a support bracket comprises a rectangular plate having an eye secured thereto on a side of the plate for receiving a lanyard, said plate having a pair of longitudinal side edges, and an elongated hook-shaped jaw hingedly secured to each longitudinal side edge of the rectangular plate for receiving a safety cable therein on a side of the plate opposite to the side having the eye, each said elongated hook-shaped jaw having a longitudinal edge hinged to a longitudinal side edge of the rectangular plate whereby the said jaw edge is substantially planar with the plate during no-load conditions and each said jaw having an opposite distal longitudinal edge spaced from the plate during no-load conditions, whereby the load transfer device can freely pass a support bracket during no load conditions.

BRIEF DESCRIPTION OF THE DRAWINGS

The load transfer device and system of the invention and the manner in which it operates will now be described in detail with reference to the accompanying drawings, in which:

FIG. 3 is a perspective view of an embodiment of support bracket of the invention mounted on a wall surface with a pair of safety cables;

FIGS. 4, 5 and 6 are end views illustrating various operative positions of the support bracket shown in FIG. 3 on a wall, ceiling and floor respectively;

DESCRIPTION OF THE PREFERRED EMBODIMENTS

Figures 1, 2:
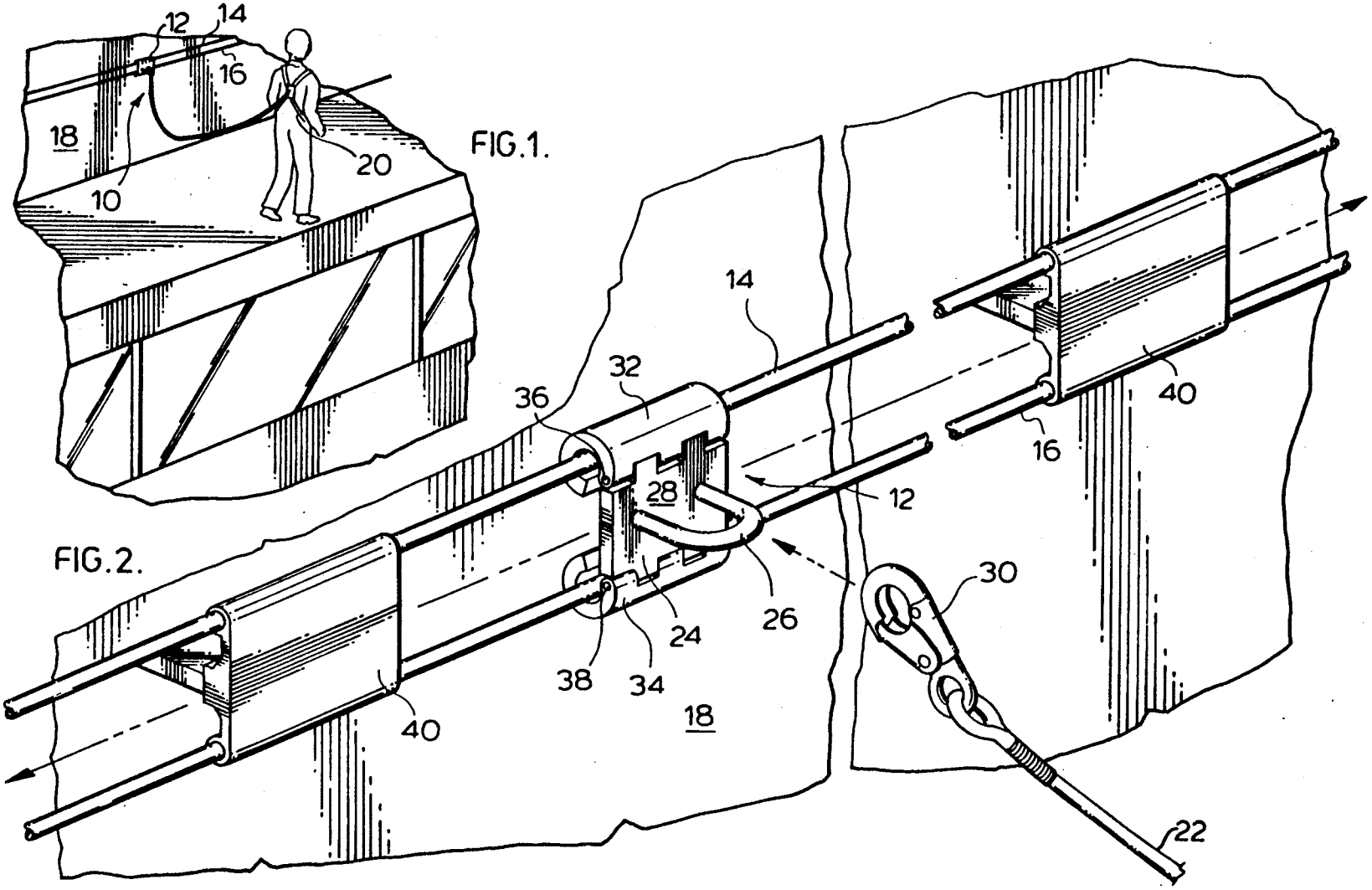
FIG. 1 is a perspective view of the system of the invention secured to a building and illustrating the use thereof.
FIG. 2 is an enlarged perspective view of the load transfer device and system of the invention shown preparatory to receiving the hook or clasp of a lanyard.

With reference to FIG. 1 of the drawings, the load transfer system of the invention designated by numeral 10 comprises a load transfer device 12 known as a travelling anchor, travelling on a pair of spaced apart parallel cables 14, 16 anchored to the wall 18 by an anchor bracket, to be described. Worker 20 walking on a ledge is tethered to device 12 by a lanyard 22. FIG. 2 illustrates in more detail load transfer device 12 which comprises a generally rectangular central plate 24 having an eye 26 secured to one side or face 28, such as by welding, for receiving hook 30 attached to the end of lanyard 22. Elongated hook-shaped jaws 32, 34 have hinges 36, 38 for articulating the jaws on plate 28 for reasons which will become evident as the description proceeds.

Jaws 32, 34 engage cables 14, 16 respectively for free sliding travel along the cables and past anchor brackets 40 which are secured to a supporting surface. FIGS. 3–6 illustrate an embodiment of bracket 40*a* having a generally T-shape with the body portion 42 having a base 44 adapted to receive securing means such as anchor bolts 46 for attaching the bracket 40*a* to a wall surface 18 as depicted in FIG. 4, ceiling or like overhead structure 48 as depicted in FIG. 5, or floor rail 50 as depicted in FIG. 6.

The head portion 52 of bracket 40*a*, which is relatively thin in section, has enlarged distal longitudinal edges 54, 56 with holes 58, 60 formed therein for receiving cables 14, 16 in snug-fitting relation.

Figure 7:
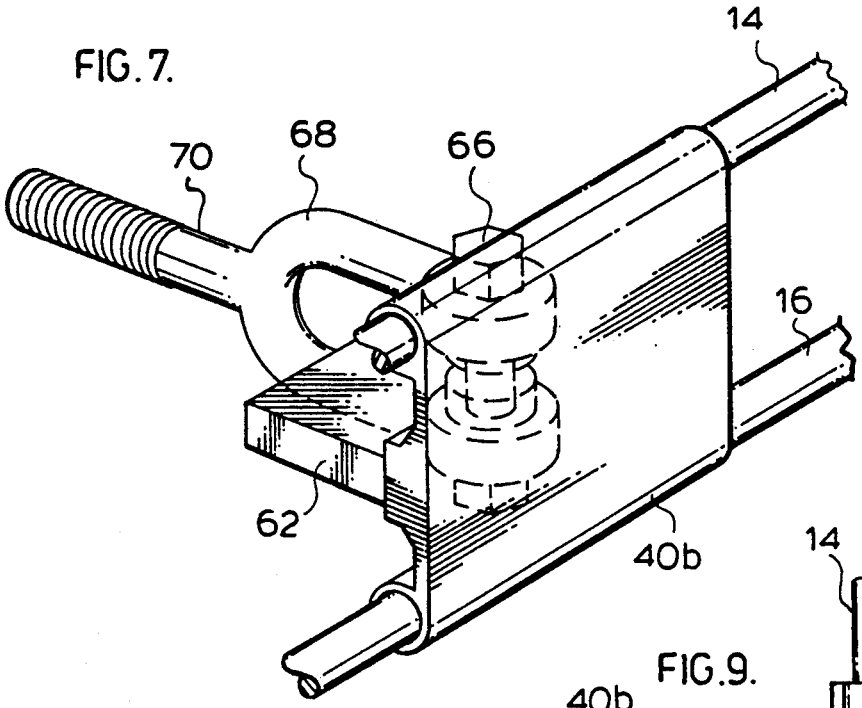
FIG. 7 is a perspective view of another embodiment of support bracket of the invention.
Figure 9:
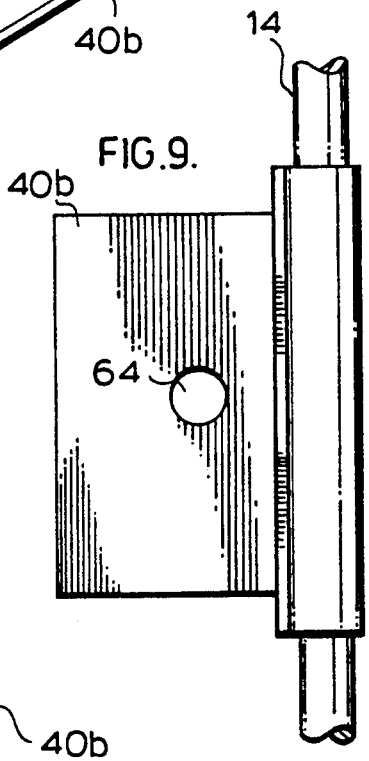
FIG. 9 is a side elevation of the support bracket shown in FIG. 7.
Figure 8:
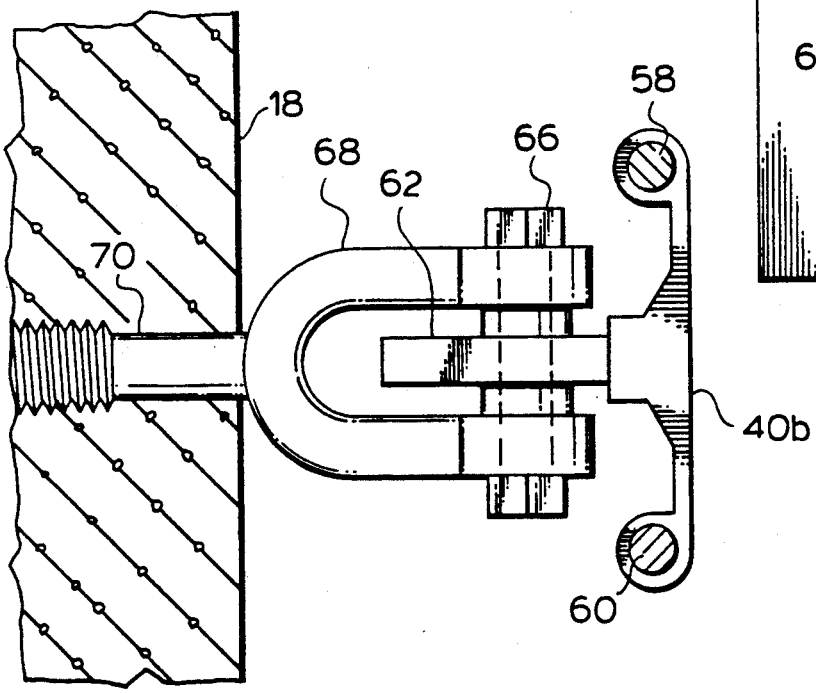
FIG. 8 is an end view of the support bracket shown in FIG. 7 with connector embedded in a wall surface.

FIGS. 7–9 illustrate another embodiment of bracket 40*b* having a planar body portion 62 with an aperture 64 formed therein for receiving bolt 66 passing through the arms of shackle 68. Shank 70, shown to be threaded, is screwed or cemented into supporting wall 18.

Figure 10:
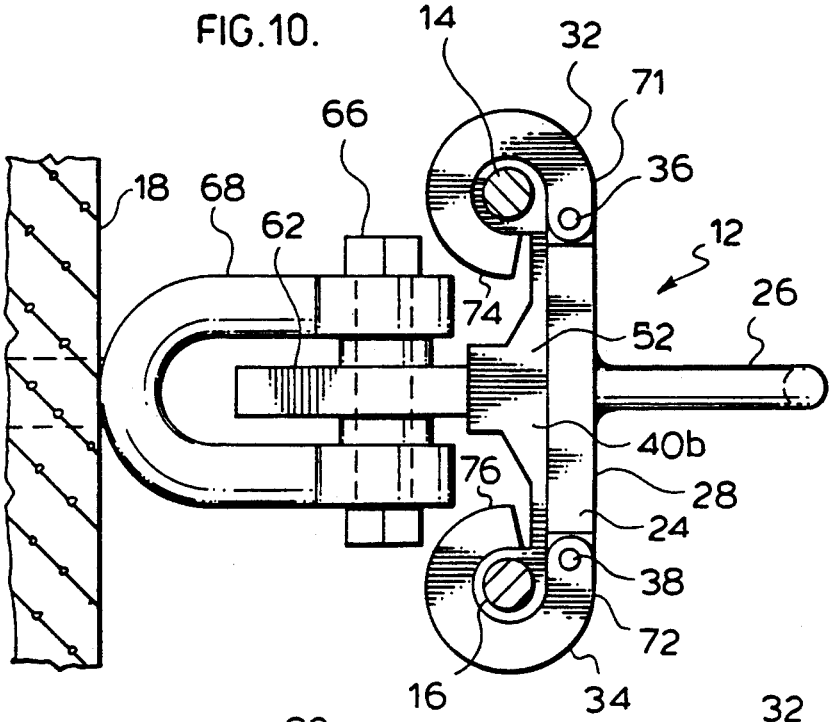
FIG. 10 is an end view of the load transfer device passing a support bracket.
Figure 11:
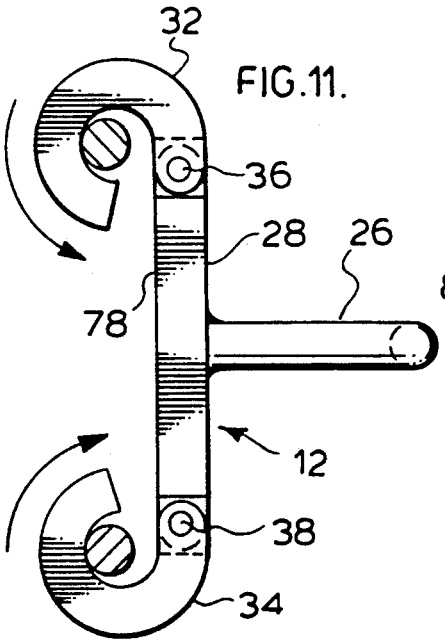
FIG. 11 is an end view of a load transfer device with support cables showing the direction of load forces acting thereon.
Figure 12:
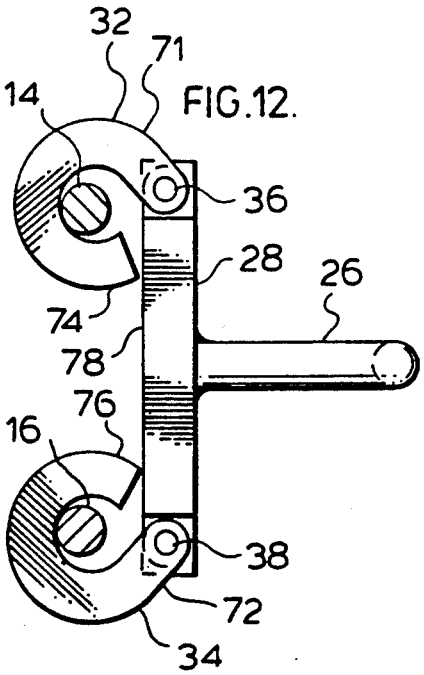
FIG. 12 is an end view of the load transfer device as shown in FIG. 11 when under load.

With reference now to FIGS. 10–12, load transfer device 12 is shown in FIG. 10 passing over bracket **40*b*, the inner portions 71, 72 of jaws 32, 34 respectively being in planar alignment with plate 24 whereby device 12 can pass over the head 52 of bracket 50*b*. The distal ends 74, 76 of jaws 32, 34 are spaced from the inner face 78 a distance sufficient to allow head 52, as depicted in FIG. 10, to pass between plate 24 and the said ends 74, 76 when the load transfer device 12** is under a no-load condition.

FIG. 11 illustrates the resolution of forces on the load transfer device as a load is exerted on the device by a pull in the direction of arrow 80. Jaws 32, 34 are pivotted inwardly towards face 78 of plate 24 until ends 74, 76 abut face 78, as shown in FIG. 12, thereby closing the space about cables 14, 16 to ensure device 12 remains on the cables to increase the margin of safety. The inner portions 71, 72 of jaws 32, 34 respectively are now out of planar alignment with head 52 of the bracket to effectively prevent the load transfer device from slipping past the adjacent bracket, thereby further enhancing the safety margin.

Brackets **40*a* or 40*b***, preferably located at 10-foot spacings, are extruded from ultra high strength aluminum alloy. The load transfer devices preferably are fabricated from stainless steel and the cables, i.e. safety lines, are galvanized or stainless steel wire ropes.

The present invention provides a number of important advantages. The system permits workers to move freely and safely along elevated surfaces. The use of two safety cables not only provides an extra margin of safety over single line systems but also ensures that the load transfer device remains continuously aligned with the support brackets for free travel over the brackets under no-load conditions regardless of location of support brackets either on walls or overhead. The pivotal jaws of the load transfer device close upon the cables when a load is imposed, such as when a worker falls and is suspended by the system, to not only ensure that the device does not pull free from the cables but also to abut a wall bracket.

It will be understood that modifications can be made in the embodiment of the invention illustrated and described herein without departing from the scope and purview of the invention as defined by the appended claims.

I claim:

1. A load transfer device for travelling along a pair of safety cables and past a support bracket comprising a rectangular plate having an eye secured thereto on a side of the plate for receiving a lanyard, said plate having a pair of longitudinal side edges, and an elongated hook-shaped jaw hingedly secured to each longitudinal side edge of the rectangular plate for receiving a safety cable therein on a side of the plate opposite to the side having the eye, each said elongated hook-shaped jaw having a longitudinal edge adapted to mate with a longitudinal side edge of the rectangular plate for receiving a hinge connection, whereby the said mating jaw edge is substantially planar with the plate and the opposite distal longitudinal jaw edge is spaced from the plate during no-load conditions to allow the load transfer device to pass a support bracket, and the mating jaw edge is out of alignment with the plate and the distal longitudinal jaw edge substantially abuts the rectangular plate to prevent the load transfer device from passing a support bracket when under load.

2. A load transfer system comprising, in combination, a plurality of elongated T-shaped support brackets each having a body portion for anchoring to a support surface and a transverse thin head portion having a pair of longitudinal, parallel side edges, each said side edge having a longitudinal opening formed therein for receiving a cable, a pair of equispaced cables seated in said longitudinal openings, and a load transfer device mounted on said cables for slidable travel on the cables and past the brackets.

3. A load transfer system as claimed in claim 2, said load transfer device comprising a rectangular plate having an eye secured thereto on a side of the plate for receiving a lanyard, said plate having a pair of longitudinal side edges, and an elongated hook-shaped jaw hingedly secured to each longitudinal edge of the rectangular plate for receiving a safety cable therein on a side of the plate opposite to the side having the eye, each said elongated hook-shaped jaw having a longitudinal edge adapted to mate with a longitudinal side edge of the rectangular plate for receiving a hinge connection, whereby the said mating jaw edge is substantially planar with the plate and the opposite distal longitudinal jaw edge is spaced from the plate during no-load conditions to allow the load transfer device to pass a support bracket, and the mating jaw edge is out of alignment with the plate and the distal longitudinal jaw edge substantially abuts the rectangular plate to prevent the load transfer device from passing a support bracket when under load.

* * * * *